US005429316A

United States Patent [19]

Arvidsson et al.

[11] Patent Number: 5,429,316

[45] Date of Patent: Jul. 4, 1995

[54] SUPPORT FOR A STATOR OF A REFINING MACHINE

[75] Inventors: Thomas Arvidsson, Laval; Steve Rowland, Thérèse, both of Canada

[73] Assignee: Kvaerner Hymac, Inc., Quebec, Canada

[21] Appl. No.: 164,322

[22] Filed: Dec. 9, 1993

[30] Foreign Application Priority Data

May 14, 1991 [CA] Canada ..... 2096271

[51] Int. Cl.[6] ..... B02C 7/11

[52] U.S. Cl. ..... 241/261.2; 241/244; 241/259.1

[58] Field of Search ..... 30/259.1, 261.2, 260.1, 30/246, 259, 259.2, 244

[56] References Cited

U.S. PATENT DOCUMENTS

| | | | |
|---|---|---|---|
| 3,023,972 | 3/1962 | Honeyman | 241/259.1 |
| 4,082,233 | 4/1978 | Reinhall | 241/247 |
| 4,220,290 | 9/1980 | Johansson | 241/261.2 |
| 4,378,092 | 3/1983 | Reinhall | 241/259.1 |

*Primary Examiner*—Douglas Watts

[57] ABSTRACT

A refiner for processing fibrous material comprising a frame, a stator, a rotor, a shaft assembly, a stator support, a stator support receiving means adapted to receive the stator support, the improvement comprising mounting the stator support receiving means on the rotor for movement of said stator towards or away from said rotor.

4 Claims, 2 Drawing Sheets

SUPPORT FOR A STATOR OF A REFINING MACHINE

The present invention relates to refiners used to grind fibrous materials such as wood pulps. More particularly this invention relates to an improved means for supporting a stator for movement away from the rotor for examination or replacement of refining plate segments.

The working surfaces of refiners are typically comprised of bars and grooves arranged more or less radially from the axis of rotation. In single disc refiners one surface is stationary while the other rotates. Fibrous materials is fed into a central opening in the stator and is subjected to a grinding action by the rotor. In pulp refiners the fibrous material is usually introduced into the refiner by means of a spiral conveyor. Different configurations of conveyors may be chosen depending on the nature of the material to be ground. The working surfaces of refiners are subject to wear and therefore replaceable refiner plate segments are used. Typically these segments must be replaced about four times per year. In order to replace these segments a system is needed to provide access to them.

In existing refiners the refiner casing is made in two or more pieces which can be unbolted and separated. Many different configurations have been proposed over the years in attempts to facilitate and simplify refiner plate changes. Each has some deficiency such as floor space requirements, crane handling requirements, compromised feeding arrangements, misalignment potential, limited access, mechanical complexity and cost.

The object of the present invention is to provide a cost effective means of supporting the stator and moving the stator in order to examine or change the refiner plates.

A further object of the present invention is to provide a refiner feed system which combines efficient material flow to the refiner with a simplified and cost effective means of changing refiner plates.

One embodiment of the invention relates to a refiner for processing fibrous material comprising a main frame, a rotor, a hollow feed screw and a stator assembly comprised of a stator, a hollow feed housing and a stator support, characterized in that the stator support is slidably supported within the hollow feed screw when the stator assembly is disconnected from the main frame for movement of the stator assembly towards or away from the rotor.

In still another embodiment the invention relates to a device for feeding a fibre processing apparatus characterized by a hollow shaft feed screw which is attached to and driven by the fibre processing apparatus' rotor and shaft assembly, the housing of the feeding device incorporates a beam which extends into the hollow shaft of the feed screw such that the feed screw, when not rotating, can support the weight of the feeder housing assembly and permit the retraction of the feeder housing assembly allowing access to the working surfaces of the fibre processing apparatus.

IN THE DRAWINGS

Figure 1:
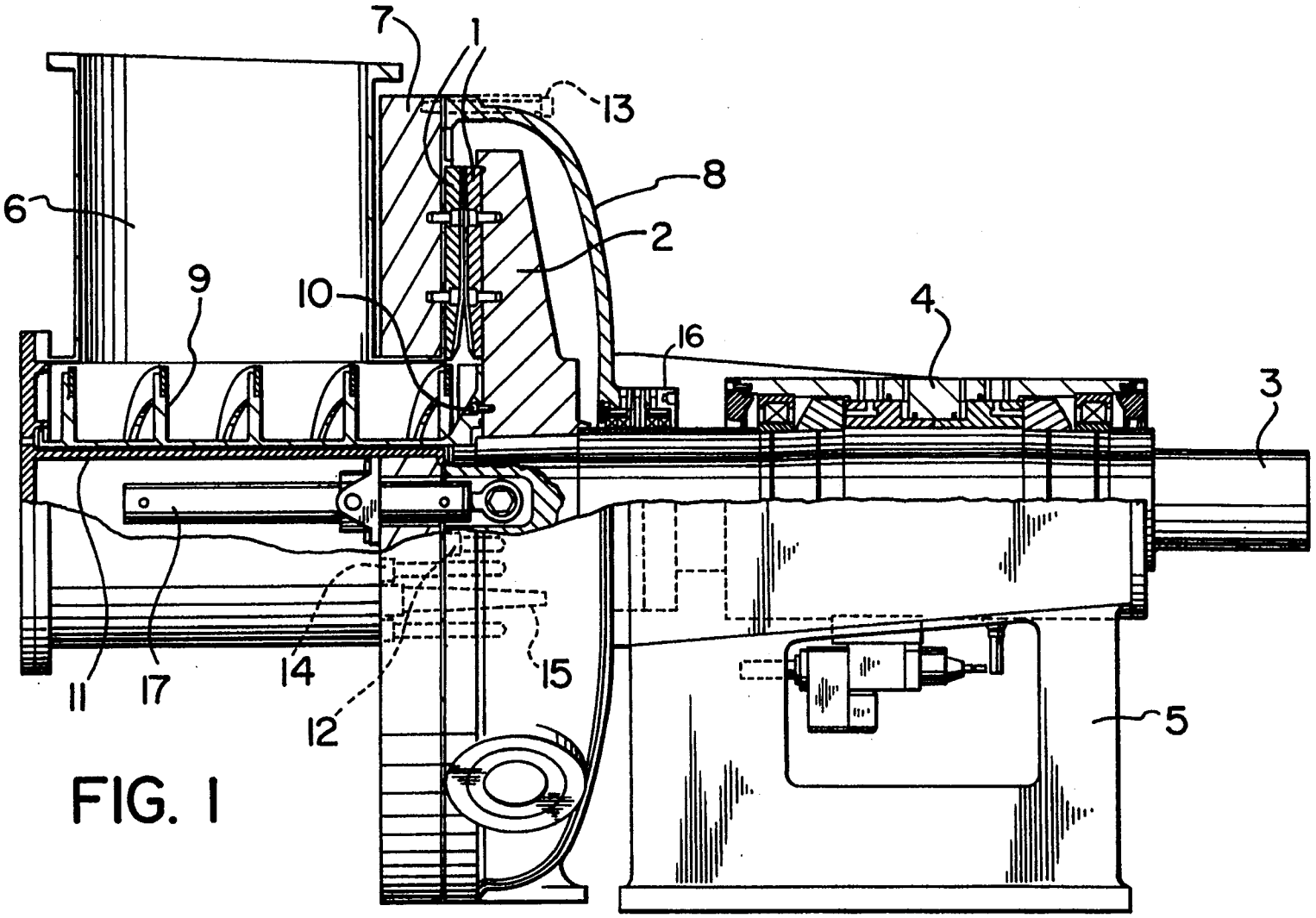
FIG. 1 shows a side view of a refiner which incorporates the invention. The lower half of this figure shows the outside of the refiner while the upper half represents a section through the vertical centreline of the machine.
Figure 2:
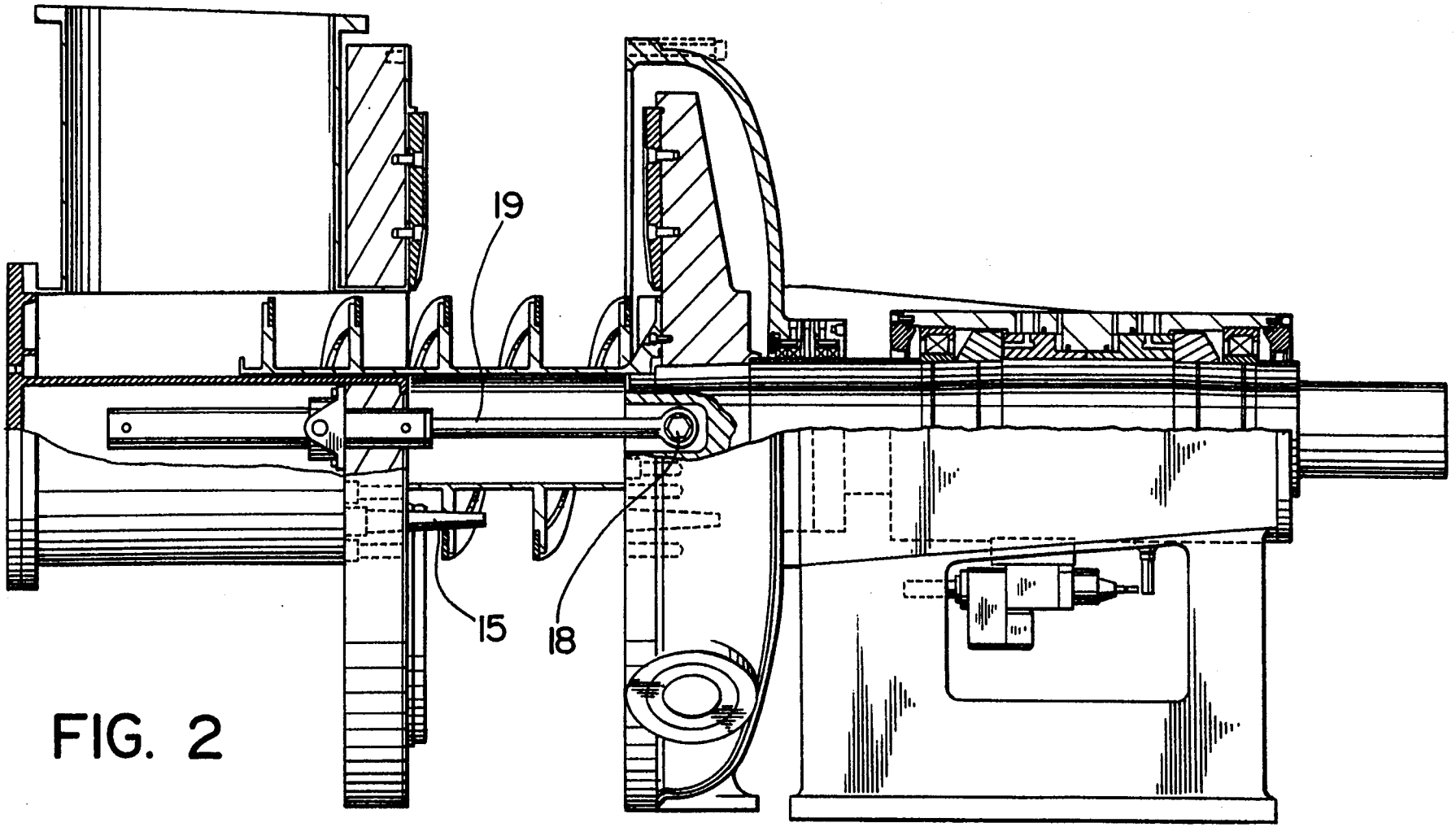
FIG. 2 is the same view as FIG. 1 but with the machine open for access to the refiner plates.

Referring to FIG. 1, the refiner plates I are fastened to the rotor 2 and the stator 7. The rotor is driven by the shaft 3 which is connected to a driving means such as an electric motor which is not shown. The shaft 3 is held within the bearing housing assembly 4 which is fastened to the main frame 5. The feed housing 6 is attached to the stator 7 and to the stator support beam 11. The feed screw 9 is hollow and is attached to the rotor 2 with fasteners 10. The stator support beam 11 extends inside the hollow feed screw. The seal between the shaft 3 and the chamber 8 is effected by the sealing device 16. The refiner chamber 8 is attached to the side arms of the frame 5 by fasteners 12. The stator 7 is also attached to the side arms of the frame 5 by fasteners 14. Two or more tapered pins 15 ensure alignment of the stator 7 with the frame 5. The chamber 8 is fastened to the stator 7 with fasteners 13. Two or more hydraulic cylinder and piston assemblies 17 are attached to the stator 7 and to the frame 5. In order to have access to the refiner plates with the refiner stopped fasteners 13 and 14 are removed. The feeder housing 6 is disconnected from any associated equipment (not shown) and equal volumes of hydraulic fluid are fed to the hydraulic assemblies 17. The stator 7, the feed housing 6 and the stator support beam 11 remain fastened together and move as a single stator assembly. The weight of this assembly is transferred to the inside of the hollow screw feeder 9 via the stator support beam 11. The stator support beam 11 slides along the inside of the screw feeder 9 and is guided by it. Referring to FIG. 2 the feeding assembly is shown retracted. Bolts 18 may be removed and the pistons 19 may be retracted in order to improve access for plate changes. Taper pins 15 may also be easily removed. Free access is provided for plate changing.

When the plate change is complete, hydraulic fluid is applied to the hydraulic assemblies 17 to close the machine. Final guidance and alignment is provided by taper pins 15. Bolts 13 and 14 are replaced and the process is complete.

While the description herein refers to refining of fibrous materials, it will be recognized by those skilled in the art that the same invention can be applied to other fibre processing devices such as dispergers, mixers, fluffers and the like.

What is claimed is:

1. In a disc type grinding apparatus in which pulp stock is ground between a non-rotatable disc and a rotatable disc, and wherein a pulp stock infeed screw is provided on a support shaft that also supports the rotatable disc, the improvement comprising:

a fixed frame for rotatably supporting the shaft such that the feed screw extends axially outwardly of said fixed frame, a movable frame including a support beam slidably received inside said feed screw, said feed screw being hollow and defining an internal cavity, and activating means in said cavity and having a fixed part secured to said fixed frame, and having a movable part secured to said movable frame whereby said movable frame and non-rotatable disc can be moved axially toward and away from said fixed frame and said rotatable disc respectively to facilitate repair of said disc and cleaning of said infeed screw in an extended position and operation of the grinding apparatus when in operable relationship.

2. The combination according to claim 1, wherein said a fixed part being secured to said fixed frame by a removable bolt whereby complete separation of said movable frame from said fixed frame can be readily accomplished.

3. The combination according to claim 1, further characterized by a feed hopper housing on said movable frame.

4. The combination according to claim 1, wherein locating pins and locating pin openings are provided on said movable and fixed frames to locate said movable frame with respect to said fixed frame when said actuator means has moved said movable frame into operable relationship to the fixed frame.

* * * * *